US010641005B2

(12) United States Patent
Garcia et al.

(10) Patent No.: US 10,641,005 B2
(45) Date of Patent: May 5, 2020

(54) FENCE POST RETAINING PLATE

(71) Applicant: W. Silver Inc., Vinton, TX (US)

(72) Inventors: Luis Garcia, El Paso, TX (US); Bhupendra Kenjale, El Paso, TX (US)

(73) Assignee: W. SILVER INC., Vinton, TX (US)

( * ) Notice: Subject to any disclaimer, the term of this patent is extended or adjusted under 35 U.S.C. 154(b) by 0 days.

(21) Appl. No.: 15/808,245

(22) Filed: Nov. 9, 2017

(65) Prior Publication Data

US 2018/0066447 A1 Mar. 8, 2018

Related U.S. Application Data

(62) Division of application No. 14/706,669, filed on May 7, 2015.

(51) Int. Cl.
*E04H 17/08* (2006.01)
*E04H 12/22* (2006.01)
*E02D 5/80* (2006.01)

(52) U.S. Cl.
CPC ..... *E04H 17/08* (2013.01); *E04H 12/2215* (2013.01); *E02D 5/80* (2013.01)

(58) Field of Classification Search
CPC ..... E04H 17/08; E04H 12/2215; E02D 5/80
See application file for complete search history.

(56) References Cited

U.S. PATENT DOCUMENTS 427,815 A 5/1890 Wolf
RE13,202 E 2/1911 Atxhison
1,089,459 A 3/1914 Booth
1,315,245 A 9/1919 Slade
1,399,426 A 12/1921 Harding
1,499,933 A 7/1924 Jones
1,637,645 A * 8/1927 Jones ..... E04H 17/08 256/47
1,649,174 A 11/1927 Meaker
1,717,557 A 6/1929 Halgrimson
1,902,875 A 3/1933 Mason
1,915,535 A 6/1933 Johnson
1,967,460 A 7/1934 Williams
2,000,232 A * 5/1935 Hyde ..... E04H 12/2215 52/153
2,189,542 A 2/1940 Caldwell
2,392,222 A 1/1946 Brickman
2,705,548 A 4/1955 Lionberger
2,809,809 A 10/1957 Johnson
2,910,149 A 10/1959 Lionberger
3,286,416 A 11/1966 Ashworth
3,831,891 A 8/1974 Jester
(Continued)

*Primary Examiner* — Basil S Katcheves
*Assistant Examiner* — Omar F Hijaz
(74) *Attorney, Agent, or Firm* — Greer, Burns & Crain Ltd.

(57) ABSTRACT

A fence comprising a plurality of T-shaped fence posts, each secured to a retention plate having securing protrusions formed thereon, a lower end of the fence post and the retention plate configured to be inserted into soil to position the fence post in a desired orientation. A plate body of the retention plate comprises a plate body including central openings for receiving a plurality of the securing protrusions formed on the fence post. The plate body has a periphery with a top edge, a bottom edge and two side edges. The plate body has a plurality of additional openings therein. Also, a retention plate and a T-shaped fence post.

5 Claims, 5 Drawing Sheets

(56) References Cited

U.S. PATENT DOCUMENTS

| | | | | | |
|---|---|---|---|---|---|
| 4,027,410 | A | * | 6/1977 | Wheeler | G09F 3/206 40/645 |
| 4,084,914 | A | | 4/1978 | Humphrey et al. | |
| 4,095,744 | A | * | 6/1978 | Villelli | A01G 25/00 239/1 |
| 5,058,337 | A | | 10/1991 | O'Connor | |
| 5,395,093 | A | * | 3/1995 | Chrisman | E04H 12/2215 256/47 |
| 5,428,927 | A | | 7/1995 | Webb et al. | |
| 5,832,672 | A | | 11/1998 | Griffiths et al. | |
| D402,863 | S | * | 12/1998 | Hickmott | D8/1 |
| 6,705,598 | B2 | * | 3/2004 | Collins | E04H 17/08 256/35 |
| 6,922,954 | B2 | | 8/2005 | Bradley | |
| D517,343 | S | * | 3/2006 | Hayes | D6/403 |
| 7,025,016 | B1 | | 4/2006 | Landes | |
| D621,072 | S | * | 8/2010 | Fickbohm | D25/119 |
| 2015/0096260 | A1 | | 4/2015 | Intagliata | |

* cited by examiner

FENCE POST RETAINING PLATE

RELATED APPLICATIONS

The present application is a divisional application of U.S. Ser. No. 14/706,669 filed on May 7, 2015, the entirety of which is hereby incorporated by reference.

BACKGROUND OF THE INVENTION

The present invention relates to a retaining plate for a fence post.

Metal T-shaped fence posts have long been provided with retaining and guiding plates that are secured to the post and help to guide the post into the ground and hold it in a desired orientation, typically holding the fence post in a vertical orientation. The guide plate is typically inserted below ground level such that a top edge of the guide plate will assist in resisting an upward movement of the fence post, thereby assisting in the retention of the fence post in a desired position and orientation.

A number of different types of arrangements have been proposed to enhance the retention of the fence post in the inserted position, however, many of these proposed structures require that the plate be shaped in a non-planar manner or be specially fastened to the fence post, adding to the cost and difficulty of manufacturing of the fence post and installation and increasing shipping, handling and storage bulk and costs.

It would be an improvement in the art if there were provided an arrangement for enhancing the retention of fence posts in the inserted position without increasing manufacturing, shipping and handling costs and without requiring additional fastening arrangements.

SUMMARY OF THE INVENTION

The present invention provides a retention plate for a fence post that enhances the resistance against removal of the fence post without requiring any non-planar bends or protrusions of the retention plate which would add to the bulk or handling size of the retention plates. Further, no special attachment arrangements or extra steps are required for securing the retention plate to the fence post.

In an embodiment of the invention, a retention plate is provided for a T-shaped fence post wherein the T-shaped fence post has a region configured to be inserted into soil and has securing protrusions formed thereon. A lower end of the fence post and a bottom edge of the retention plate are configured to be inserted into soil to position the fence post in a desired orientation.

The retention plate comprises a plate body including central openings aligned along a centerline of the plate body for receiving a plurality of the securing protrusions formed on the fence post in the region of the fence post to be inserted into the soil. The plate body has a periphery with a top edge, the bottom edge and two side edges. The plate body has a plurality of additional openings therein, other than the central openings, configured and arranged to increase a resistance to the plate from being extracted from the soil.

In an embodiment, the side edges of the plate body have a plurality of recesses formed therein comprising the openings, the recesses being defined by at least two side walls, at least one of which extends at an acute angle relative to a line perpendicular to the centerline towards the top edge.

In an embodiment, one side wall of each recess extends at an acute angle and another side wall of each recess extends at an angle no greater than perpendicular relative to the centerline of the plate body.

In an embodiment, both side walls extend at an acute angle relative to the line perpendicular to the centerline.

In an embodiment, a face of the plate body is planar.

In an embodiment, the openings are contained wholly within the body of the plate and do not extend to the periphery of the plate.

In an embodiment, the openings are U-shaped.

In an embodiment, the openings are V-shaped.

In an embodiment, at least two openings are arranged along both side edges.

In an embodiment, some of the additional openings are contained wholly within the body of the plate and do not extend to the periphery of the plate, while other openings are arranged in the side edges of the plate body forming a plurality of recesses therein, the recesses being defined by at least two side walls, at least one of which extends at an acute angle relative to a line perpendicular to the centerline towards the top edge.

In an embodiment, the top edge and the bottom edge are non-linear.

In an embodiment, the top edge and the bottom edge are complementarily shaped.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures in which like reference numerals identify like elements, and in which:

DETAILED DESCRIPTION OF THE PREFERRED EMBODIMENTS

Figure 2:
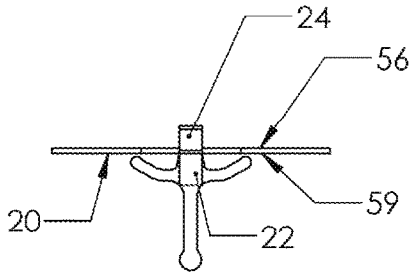
FIG. 2 is a top elevational view of a fence post and the embodiment of the fence post retaining plate of FIG. 1 secured together.
Figure 1:
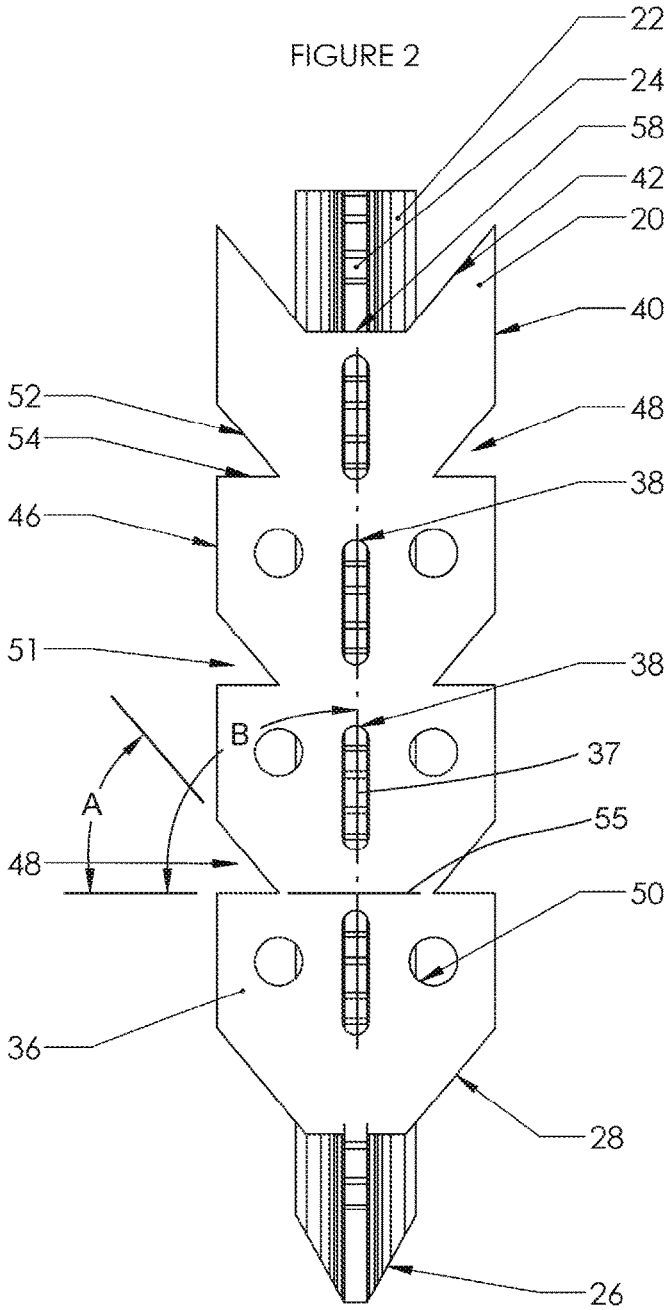
FIG. 1 is a front elevational view of a fence post and an embodiment of a fence post retaining plate secured together.
Figure 3:
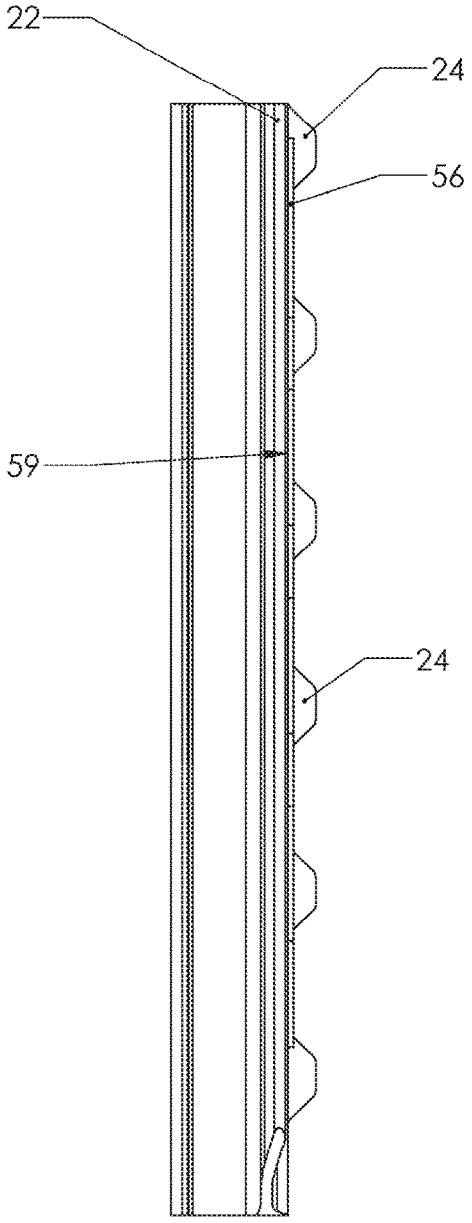
FIG. 3 is a side elevational view of a fence post and the embodiment of the fence post retaining plate of FIG. 1 secured together.

FIGS. 1-3 illustrate a retention plate 20 for a standard T-shaped metal fence post 22 that enhances the resistance against removal of the fence post without requiring any non-planar bends or protrusions of the retention plate. Further, no special attachment arrangements or extra steps are required for securing the retention plate 20 to the fence post 22.

In a typical T-shaped metal fence post 22 there are securing protrusions 24 formed thereon for supporting the fencing to be held by the fence posts and for receiving the retention plate 20. Both a lower end 26 of the fence post 22 and a bottom edge 28 of the retention plate 20 may be configured to be inserted into soil to position and hold the fence post in a desired orientation.

The retention plate 20 comprises a plate body 36 including central openings 38 aligned along a centerline 37 of the plate body for receiving a plurality of the securing protrusions 24 formed on the fence post 22. The plate body 26 has a periphery 40 with a top edge 42, the bottom edge 28 and two side edges 46. The plate body 26 has a plurality of additional peripheral 48 and interior 50 openings therein configured and arranged to increase a resistance against the plate being extracted from the soil. The top edge 42 and bottom edge 28 preferably are shaped complementarily such that the plate bodies 36 can be stamped or cut out of a metal sheet, with adjacent plate bodies being severed from one another along the top edge 42 of one plate body and the bottom edge 28 of another plate body, without waste of any metal material between the plate bodies. In the embodiments shown in the drawings, the top edge 42 and the bottom edge 28, although shaped complementary, are non-linear and may include a central portion substantially perpendicular to the side edges 46 and lateral portions which are angled relative to the central portion such that the lateral portions of the top and bottom edges angle outwardly from the central portion and upwardly relative to the top and bottom edge central portions. In other embodiments, the top edge 42 and the bottom edge 28 may be linear.

The retention plate 20 is held on the fence post 22 by engaging the central openings 38 over a series of the protrusions 24, such as 2, 3, 4 or more protrusions, and then upsetting or peening the protrusions over a front face 56 of the plate body 36 as is standard and known in the art. No separate or additional fasteners are required for securing the retention plate 20 on the fence post 22.

In the embodiment shown in FIGS. 1-3, the side edges 46 of the plate body 36 have a plurality of recesses 51 formed therein comprising the peripheral openings 48, the recesses being defined by at least two side walls 52, 54, at least one of which, side wall 52, extends at an acute angle A relative to a line 55 which is parallel to a central portion 58 of the top edge 42 and perpendicular to the centerline 37. The acute angle A is located on a side of the line 55 which is towards the top edge 42.

Figure 7:
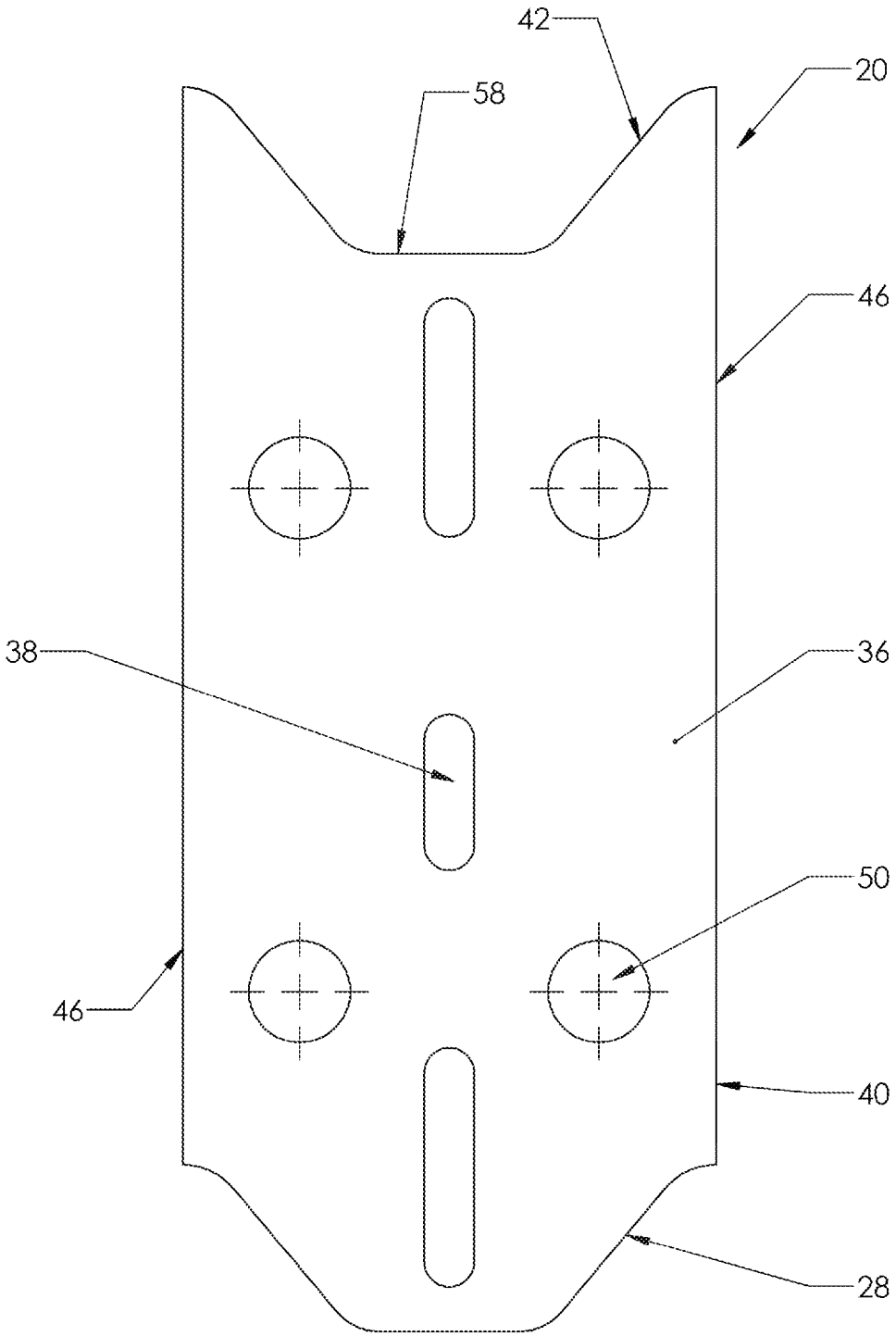
FIG. 7 is a front elevational view of another embodiment of a fence post retaining plate in isolation.

The plate body 36 may also include the interior openings 50 which are wholly contained within the plate body and which do not extend to the periphery 40 of the plate body. FIGS. 1 and 7 show embodiments with such interior openings 50. The interior openings 50 may be circular, rectangular, triangular, or have other shapes.

Preferably the central openings 38 and the additional openings 48, 50 are stamped, punched, drilled or otherwise formed in the metal sheets at the time the individual retention plates are severed from the metal sheets. The severing of the retention plates 20 and forming of the central openings 38 and the additional openings 48, 50 may occur simultaneously or serially.

FIGS. 4-7 show various other embodiments of the retention plate 20 having differently shaped, oriented or numbers of additional openings 48 or 50.

In the embodiments shown in FIGS. 1-6, the first side wall 52 of each recess 51 in the side edges 46 extends at the acute angle A relative to the line 55 which is parallel to the central portion 58 and perpendicular to the centerline 37 and the second side wall 54 of each recess 51 in the side edges 46 extends at an angle B no greater than perpendicular relative to the centerline 37 extending perpendicularly from line 55 to the central portion 58 the top edge 42. In the embodiments of FIGS. 1-5, the second side wall 54 is oriented substantially at the perpendicular angle B relative to the centerline 37 extending to the central portion 58 of the top edge 42.

Figure 6:
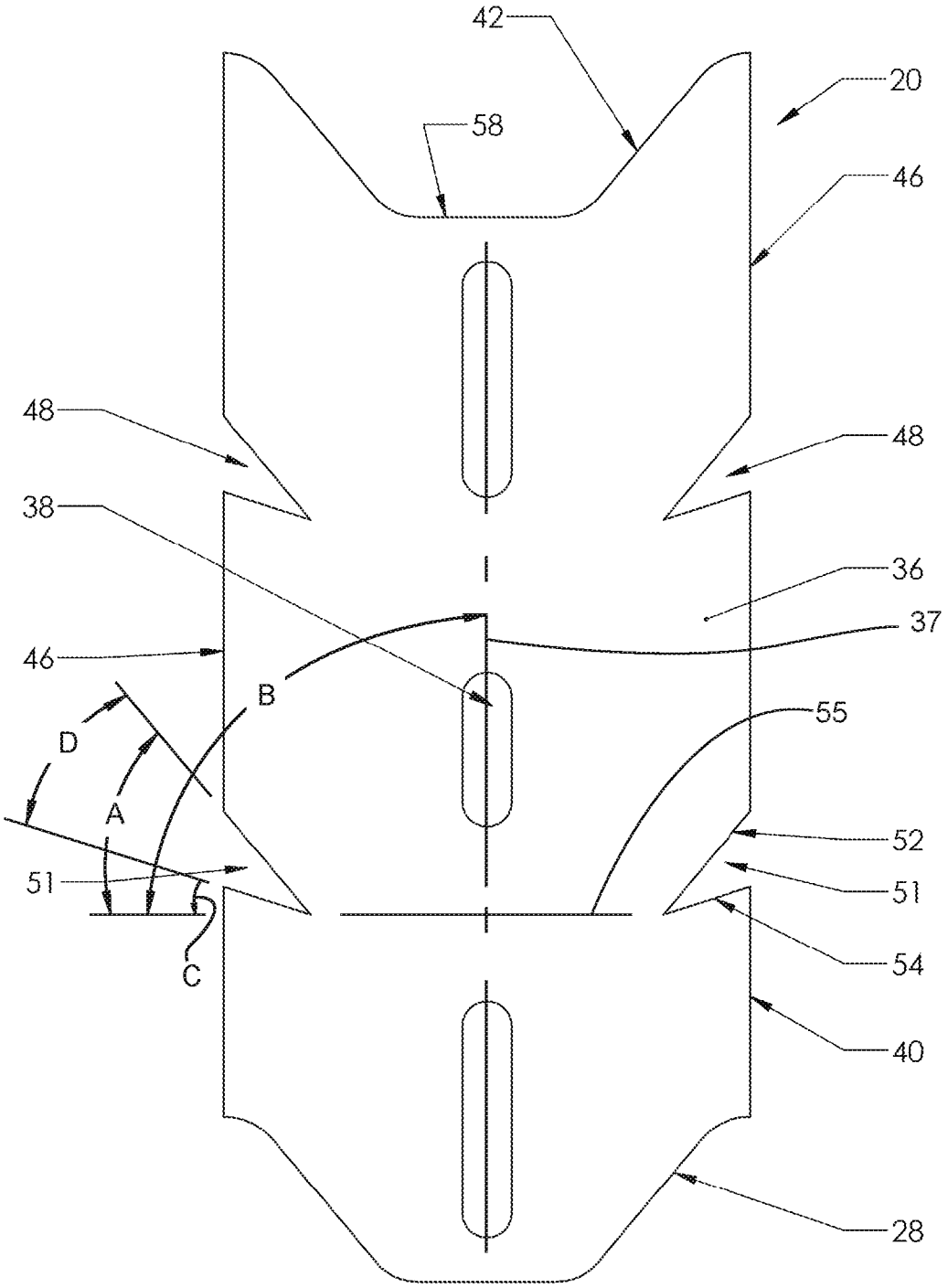
FIG. 6 is a front elevational view of another embodiment of a fence post retaining plate in isolation.

In the embodiment of FIG. 6, both side walls 52, 54 extend at an acute angle A, C relative to the line 55 which is parallel to the central portion 58 of the top edge and perpendicular to the centerline 37.

In an embodiment, as shown in FIGS. 2-3, the front 56 and a back 59 face of the plate body 36 are planar. In other embodiments, the front 56 and back 59 face of the plate body 36 could have bends or other configurations achievable via stamping or pressing, such that the faces of the plate body would not be completely planar. In the event the plate bodies 36 are planar, they may be stacked on one another to form a compact grouping for shipping and handling. In the event to the plate bodies 36 are formed with one or more bends, they may still be complementarily shaped on their large faces such that they can be compactly stacked for shipping and handling. There are no protrusions, fasteners, or other accessories associated with the plates that would prevent them from being compactly stacked on one another during shipping and storage.

Figure 4:
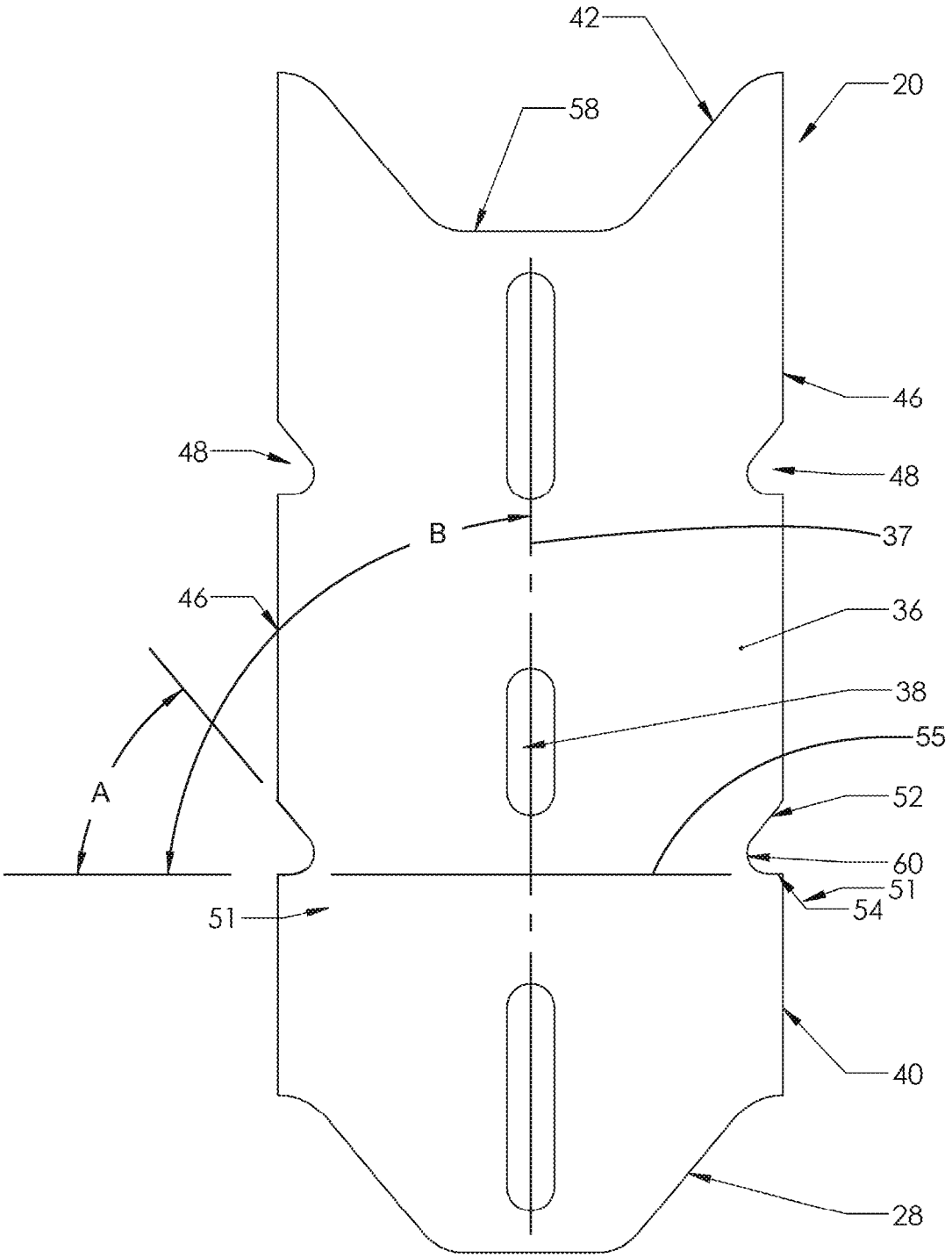
FIG. 4 is a front elevational view of another embodiment of a fence post retaining plate in isolation.

In the embodiment of FIG. 4, the openings 48 are U-shaped in that the side walls 52, 54 are joined by a curved wall 60.

Figure 5:
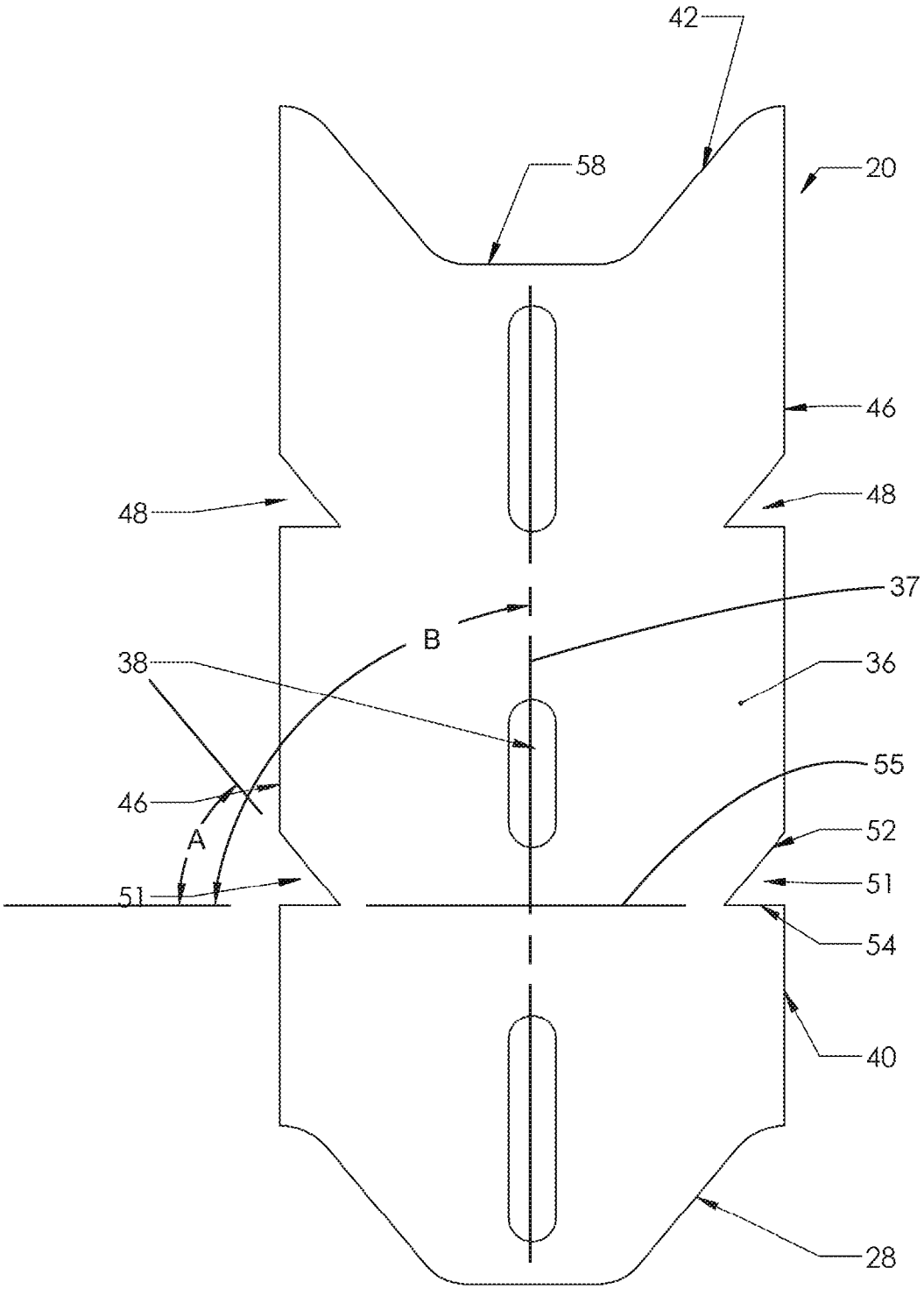
FIG. 5 is a front elevational view of another embodiment of a fence post retaining plate in isolation.

In the embodiments of FIGS. 1, 5 and 6, the openings 48 are V-shaped, such that the side walls 52, 54 join each other directly at an acute angle D. In other embodiments, the side walls 52, 54 may be joined by other straight or curved walls not specifically shown in the drawings.

In the embodiments of FIGS. 4-6, two openings 48 are arranged along both side edges 46. In the embodiment of FIG. 1, three openings 48 are arranged along both side edges 46. In the embodiment of FIG. 7, no openings are arranged along either side edge 46, but instead the openings 50 are contained wholly within the body 36 of the plate 20 and do not extend to the periphery of the plate. In other embodiments, the number of openings 48 along each side edge 46 may also be one or more than two.

As is apparent from the foregoing specification, the invention is susceptible of being embodied with various alterations and modifications which may differ particularly from those that have been described in the preceding specification and description. Various embodiments or portions of the disclosed embodiments may be combined with one another in arrangements not specifically shown or described herein. It should be understood that I wish to embody within the scope of the patent warranted hereon all such modifications as reasonably and properly come within the scope of my contribution to the art.

The invention claimed is:

1. A fence comprising:

a T-shaped fence post comprising a region configured to be inserted into soil and having securing protrusions formed thereon;

a retention plate secured to the T-shaped fence post, the retention plate comprising:

a plate body including central openings aligned along a centerline of the plate body, the plate body having a periphery with a top edge, a bottom edge and two side edges, the two side edges being parallel to one another, the plate body having a plurality of additional openings therein, other than the central openings, configured and arranged to increase a resistance to said plate from being extracted from the soil, at least two of the additional openings being arranged with one opening of the at least two additional openings positioned along each of the two parallel side edges, the at least two additional openings being formed in the plate body between a line extending along one of the side edges and the centerline of the plate body, wherein the additional openings arranged along the side edges comprise recesses which are defined by two side walls, one of the two side walls extending, in a direction away from the centerline, at an acute angle relative to the line perpendicular to the centerline, and the other side wall of each recess extending at an angle no greater than perpendicular relative to the centerline of the plate body, and wherein the additional openings from the plurality of additional openings are U-shaped having a curved wall join the two side walls, and, the plate body being completely planar and having no portions with bends or protrusions, wherein the top edge has a central portion that is parallel to a line perpendicular to the centerline of the plate body, and wherein the bottom edge has a portion that is parallel to the central portion of the top edge.

2. The fence according to claim 1 wherein the T-shaped fence post is secured to the retention plate via deformation of the securing protrusions, without the use of any additional fasteners.

3. The fence according to claim 1, wherein the top edge and the bottom edge are non-linear.

4. The fence according to claim 1, wherein the top edge and the bottom edge are complementarily shaped.

5. A retention plate and a T-shaped fence post, comprising:

the T-shaped fence post having securing protrusions formed thereon, the T-shaped fence post having a lower end configured to be inserted into soil to position the fence post in a desired orientation, the retention plate comprising:

a bottom edge configured to be inserted into soil, a planar plate body and including central openings aligned along a centerline of the plate body for receiving a plurality of the securing protrusions formed on the fence post, the plate body having a periphery comprising a top edge, the bottom edge and two side edges, the two side edges being parallel to one another, the parallel side edges of the plate body having a plurality of recesses formed therein configured and arranged to increase a resistance to said plate from being extracted from the soil, each recesses being defined by two side walls, one of said side walls of each recess extending, in a direction away from the centerline, at an acute angle relative to a line perpendicular to the centerline and another of said side walls of each recess extending away from the centerline and towards a line parallel with the top edge at an angle no greater than perpendicular to the centerline of the plate body, and wherein the additional openings from the plurality of additional openings are U-shaped having a curved wall join the two side walls, the plate body comprising additional openings arranged between the side edges and the centerline of the plate body, wherein the plate body comprises a one piece plate being completely planar and having no portions with bends or other protrusions, wherein the fence post and the plate body are secured to one another via deformation of the securing protrusions, without the use of any additional fasteners, and wherein the top edge has a central portion that is parallel to the line perpendicular to the centerline of the plate body, and wherein the bottom edge has a portion that parallel to the central portion of the top edge.

* * * * *